US011167823B2

(12) United States Patent
Keown et al.

(10) Patent No.: US 11,167,823 B2
(45) Date of Patent: Nov. 9, 2021

(54) SURVIVAL CRAFT

(71) Applicant: Survitec Group Limited, Birkenhead (GB)

(72) Inventors: Damian Keown, Belfast (GB); Cyril Stocker, Carrickfergus (GB); Richard McCormick, Belfast (GB); Iain McLean, Lurgan (GB)

(73) Assignee: Survitec Group Limited, Birkenhead (GB)

( * ) Notice: Subject to any disclaimer, the term of this patent is extended or adjusted under 35 U.S.C. 154(b) by 0 days.

(21) Appl. No.: 16/725,366

(22) Filed: Dec. 23, 2019

(65) Prior Publication Data

US 2020/0148319 A1 May 14, 2020

Related U.S. Application Data

(62) Division of application No. 15/111,978, filed as application No. PCT/EP2015/050399 on Jan. 12, 2015, now Pat. No. 10,549,825.

(30) Foreign Application Priority Data

Jan. 16, 2014 (GB) ..... 1400737

(51) Int. Cl.
*B63B 21/00* (2006.01)
*B63B 21/20* (2006.01)
(Continued)

(52) U.S. Cl.
CPC ..... *B63B 21/00* (2013.01); *B63B 7/082* (2013.01); *B63B 23/00* (2013.01); *B63C 9/02* (2013.01);
(Continued)

(58) Field of Classification Search
CPC ..... B63B 7/08; B63B 7/082; B63B 21/00; B63B 2021/005; B63B 21/20;
(Continued)

(56) References Cited

U.S. PATENT DOCUMENTS 1,913,830 A * 6/1933 Campbell ..... B63B 23/18 114/374
2,686,491 A * 8/1954 Ohmstede ..... E02B 3/24 114/230.23

(Continued)

FOREIGN PATENT DOCUMENTS

WO WO-9535233 A1 * 12/1995 ..... B63C 9/22

*Primary Examiner* — Ajay Vasudeva
(74) *Attorney, Agent, or Firm* — Maschoff Brennan

(57) ABSTRACT

A survival craft comprises a hull (10) formed from inflatable members (12, 13) and mounting a powered propulsion system (18, 19) for the survival craft. A superstructure (11) is mounted on the hull and formed from inflatable members (25, 26, **29*a*-29*i*) and a flexible roof (28) supported by the inflatable members (25, 26, 29*a*-29*i*). The superstructure provides the hull (10) with increased longitudinal rigidity that reduces the tendency of the hull (10) to bow longitudinally when the propulsion system (18, 19**) is operating. The survival craft forms part of a marine escape system with the survival craft deflated and packed in a container including an inflation system for the survival craft. The system has a deployment system for amounting on a marine structure and carrying the container with the deployment system transferring the container from the structure to the water where the inflation system inflates the survival craft for access by persons.

5 Claims, 17 Drawing Sheets

Figure 1:
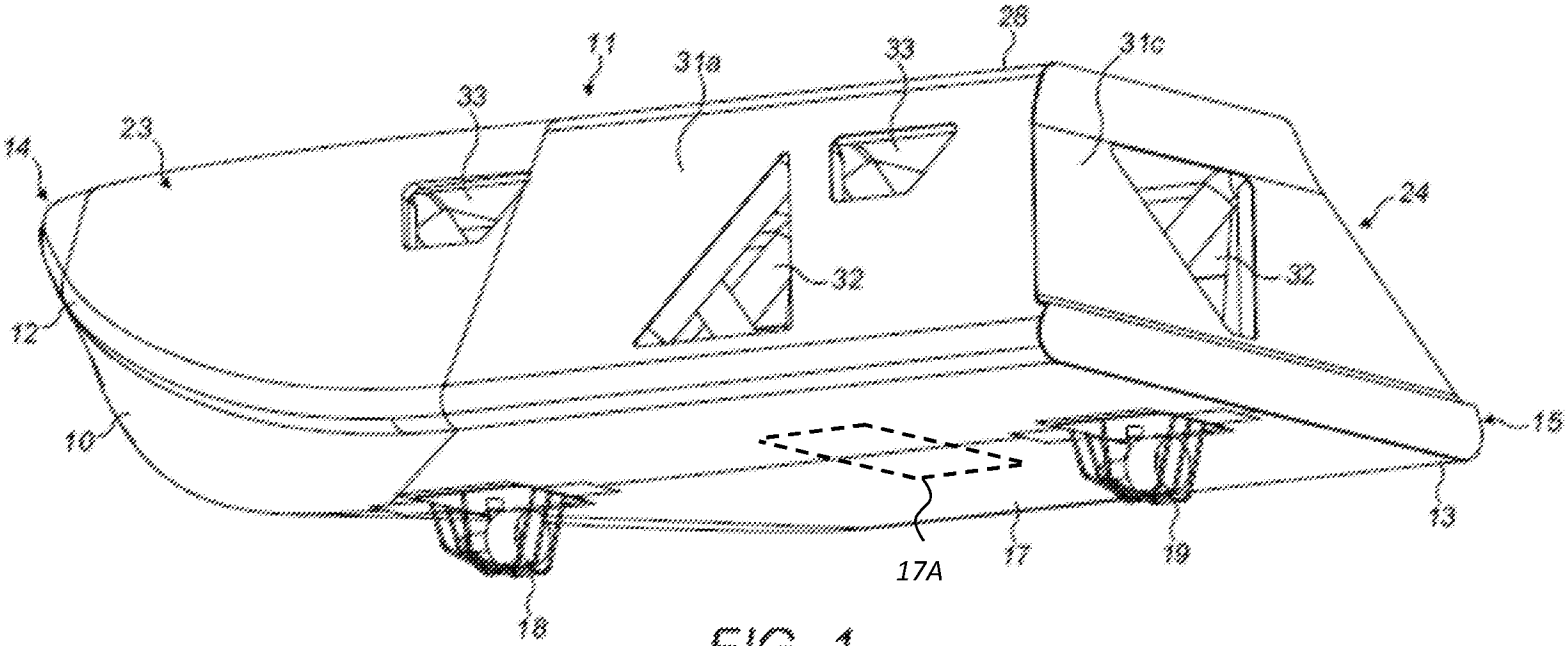

(51) Int. Cl.

| | |
|---|---|
| ***B63B 23/00*** | (2006.01) |
| ***B63C 9/02*** | (2006.01) |
| ***B63C 9/04*** | (2006.01) |
| ***B63B 7/08*** | (2020.01) |
| *B63B 27/28* | (2006.01) |

(52) U.S. Cl.
CPC ..... *B63C 9/04* (2013.01); *B63B 7/08* (2013.01); *B63B 27/28* (2013.01); *B63B 2021/206* (2013.01); *B63C 2009/042* (2013.01); *B63C 2009/044* (2013.01)

(58) Field of Classification Search
CPC ..... B63B 2021/203; B63B 2021/206; B63B 21/29; B63B 23/00; B63B 23/34; B63B 27/28; B63C 9/02; B63C 9/04; B63C 2009/042; B63C 2009/044
See application file for complete search history.

(56) References Cited

U.S. PATENT DOCUMENTS

| | | | | | |
|---|---|---|---|---|---|
| 3,060,884 | A * | 10/1962 | Wood | E02B 3/24 | 114/230.24 |
| 5,265,553 | A * | 11/1993 | Brydges | E02B 3/24 | 114/230.22 |
| 5,765,500 | A * | 6/1998 | Nordbø | B63C 9/22 | 114/366 |
| 6,227,136 | B1 * | 5/2001 | Shapiro | B63B 21/00 | 114/230.2 |
| 7,159,527 | B2 * | 1/2007 | Nielsen | B63B 21/00 | 114/230.2 |
| 8,453,590 | B1 * | 6/2013 | Pittman | B63B 21/00 | 114/230.24 |
| 10,549,825 | B2 * | 2/2020 | Keown | B63B 23/00 | |

* cited by examiner

SURVIVAL CRAFT

This application is a divisional of U.S. patent application Ser. No. 15/111,978, filed Jul. 15, 2016, which is a U.S. National Stage Entry application of PCT Patent Application No. PCT/EP2015/050399, filed Jan. 12, 2015, which claims priority to UK Application No. 1400737.1, filed Jan. 16, 2014, all of which are incorporated herein by reference in their entireties.

The invention relates to survival craft.

A known form of survival craft is a lifeboat for use on a marine structure such as an offshore oil rig or a ship comprises a conventional rigid hull carrying a protective shelter and is mounted on the structure by davits from which, after loading with people, it can be lowered into the water. The lifeboat may be provided with an engine to allow it to propel itself away from the structure after entering the water.

The provision of rigid lifeboats and the associated davits occupy significant space on marine structures. This is a particular problem on passenger ships such as cruise ships where the space taken by the lifeboats and davits reduces the number cabins available with side views.

According to a first aspect of the invention, there is provided a survival craft comprising a hull formed from inflatable members and mounting a propulsion system for the survival craft, and a superstructure carried by the hull and formed from inflatable members, the superstructure providing the hull with additional longitudinal rigidity.

In this way, the craft can be stored on the structure in deflated form in a compact manner and, when deployed and inflated provide both the ability to carry people and the ability to move clear of the structure under its own propulsion. In the absence of the superstructure, the provision of the propulsion system would tend to bow the craft in a longitudinal direction. In addition, the superstructure can provide shelter.

Preferably, the propulsion system comprises at least one electrical motor and associated propeller mounted beneath the hull and receiving electrical power from a power source. The power source may be within the hull or outside the hull. Where the power source is outside the craft, the power source may be carried by a pod including also the propulsion system and mounted beneath the hull.

According to a second aspect of the invention, there is provided a marine escape system comprising a deployment system for mounting on a marine structure and carrying a deflated survival craft according to the first aspect of the invention, the deployment system transferring the container from the structure to the water where the inflation system inflates the survival craft.

Figure 2:
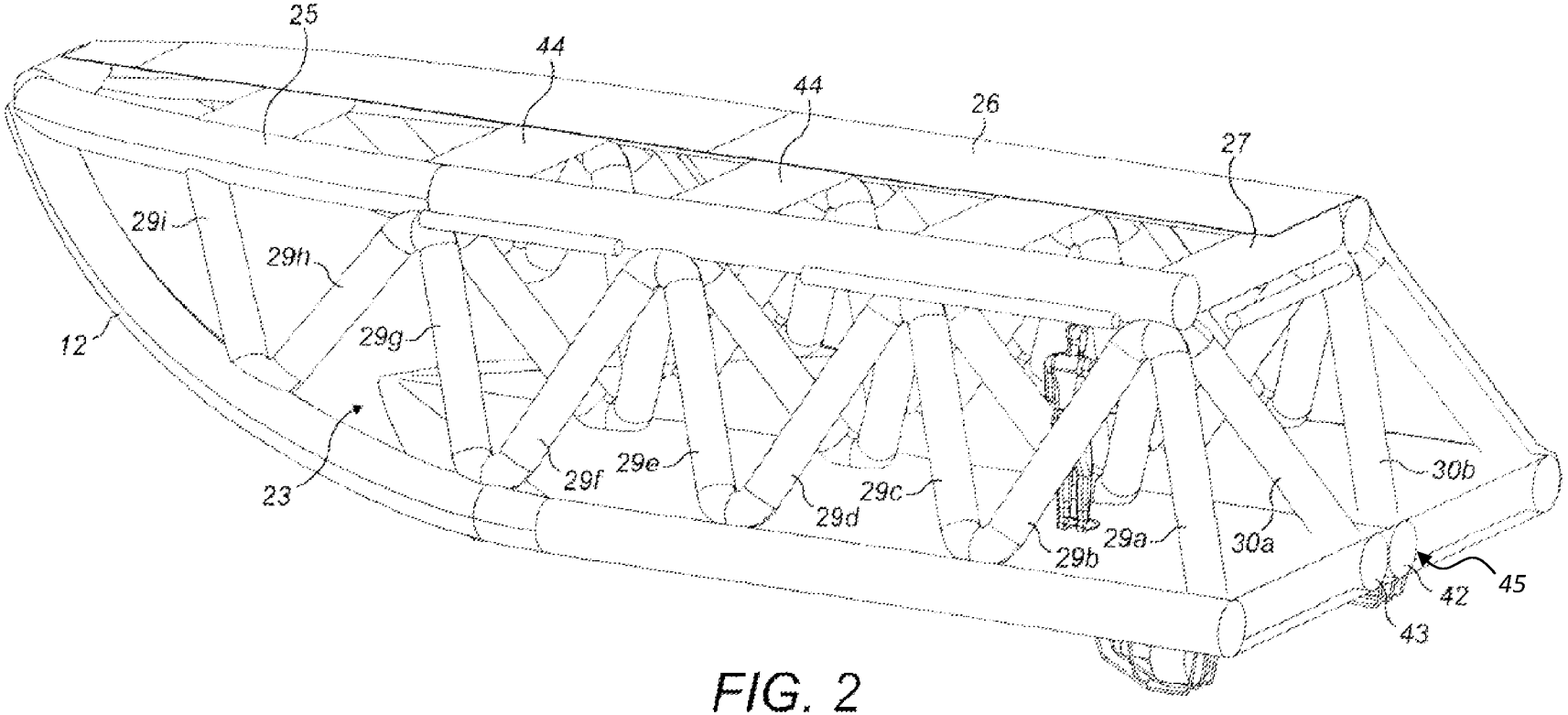
Figure 3:
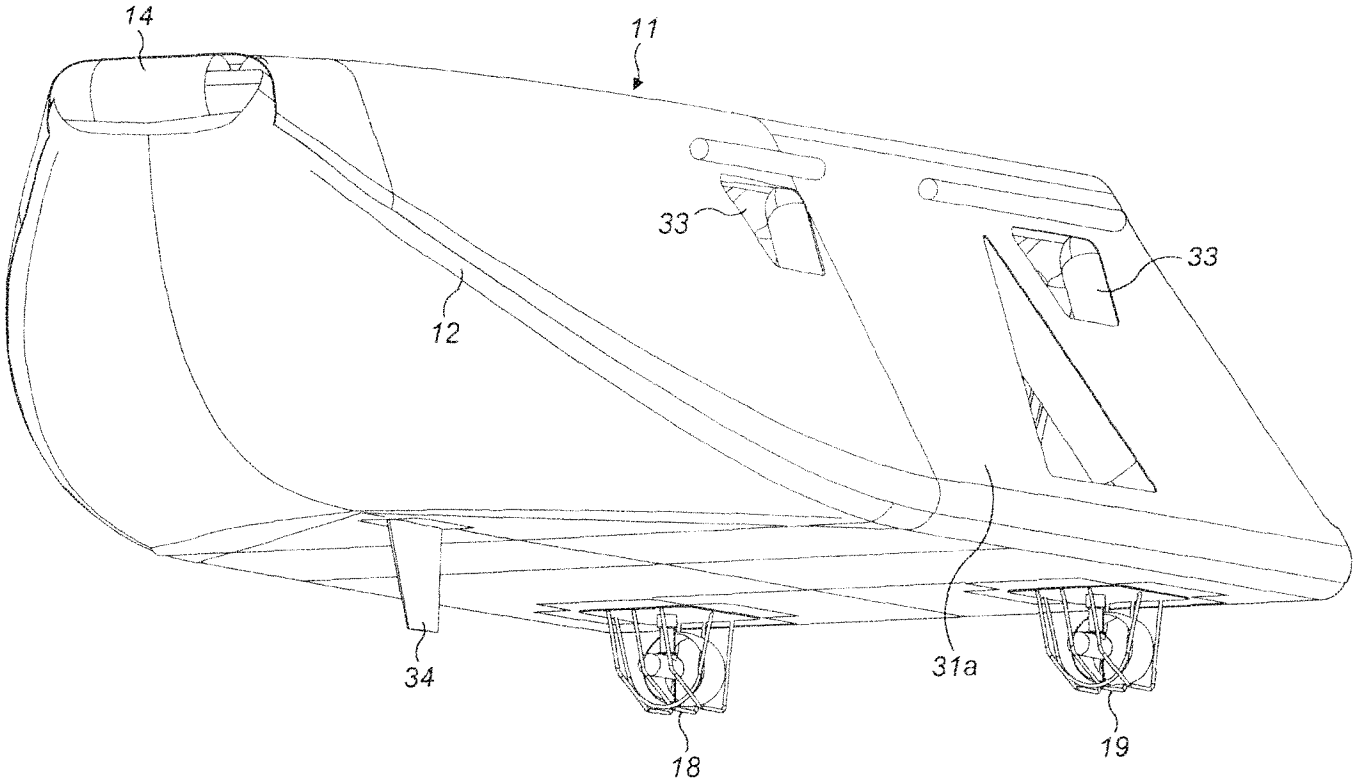
Figure 4:
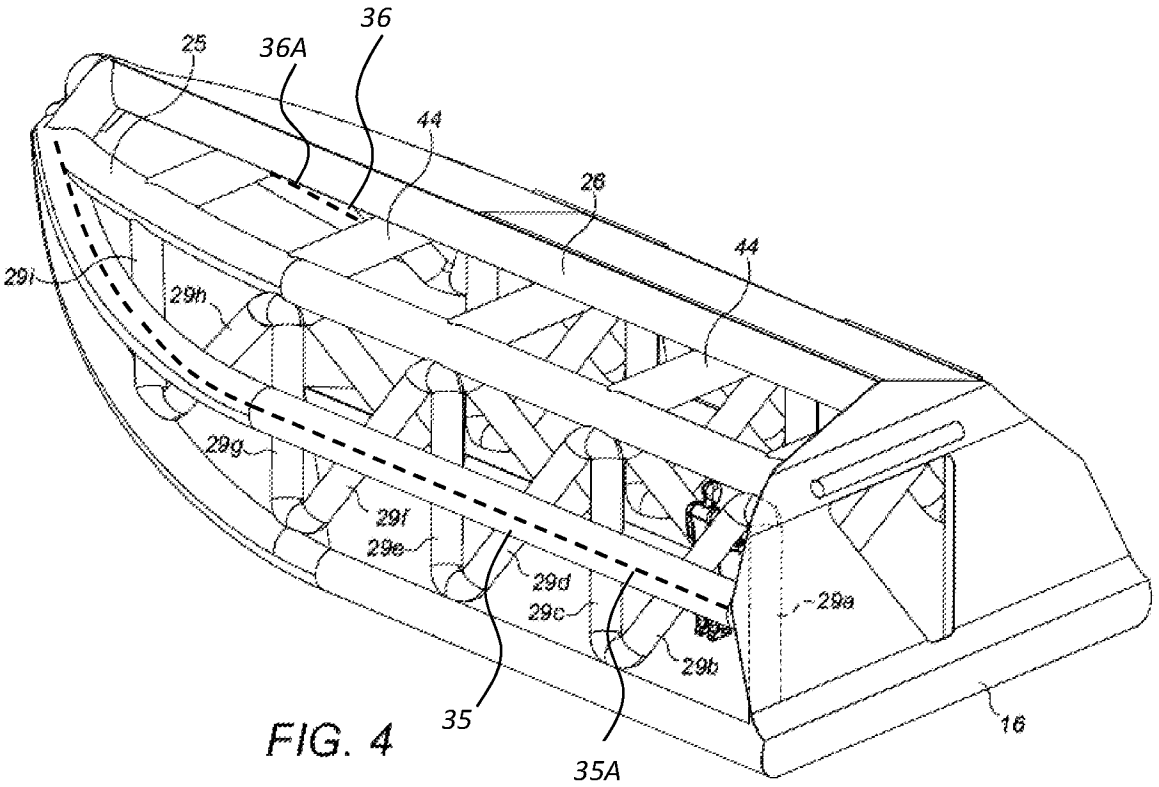
Figure 5:
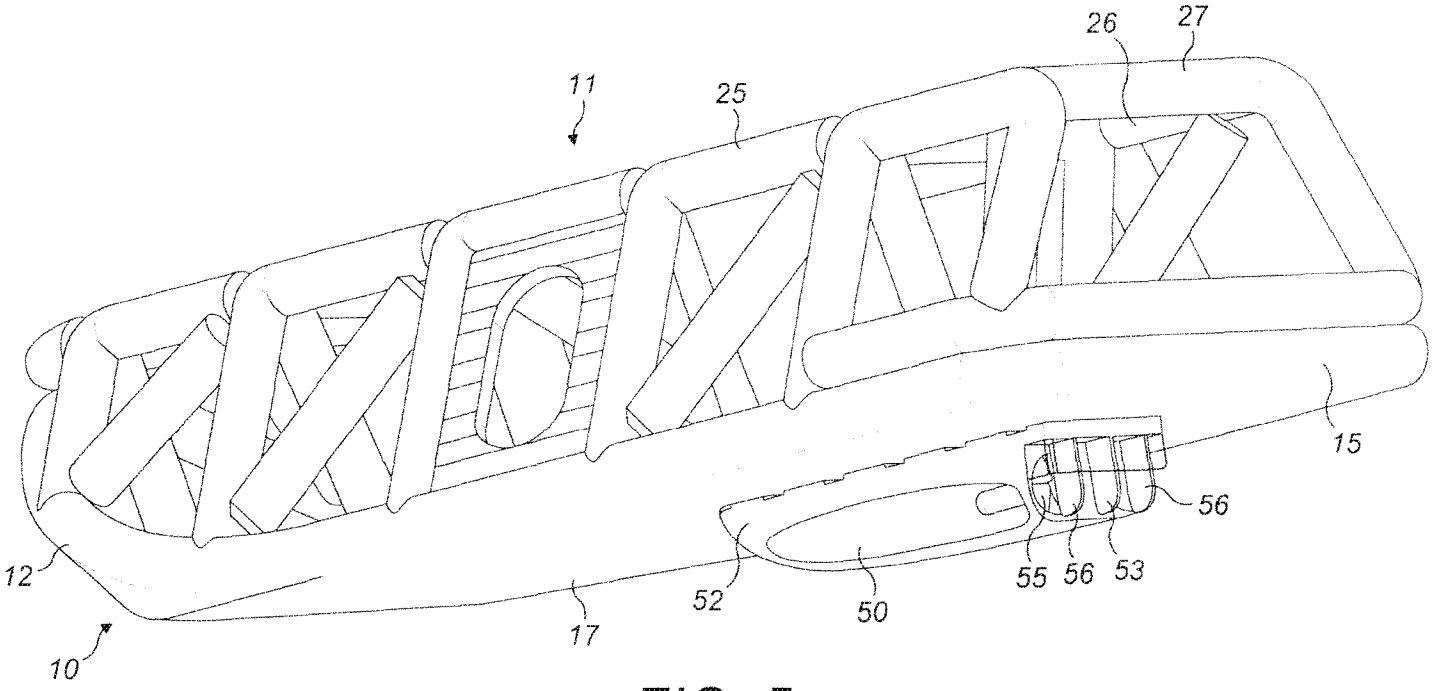
Figure 6:
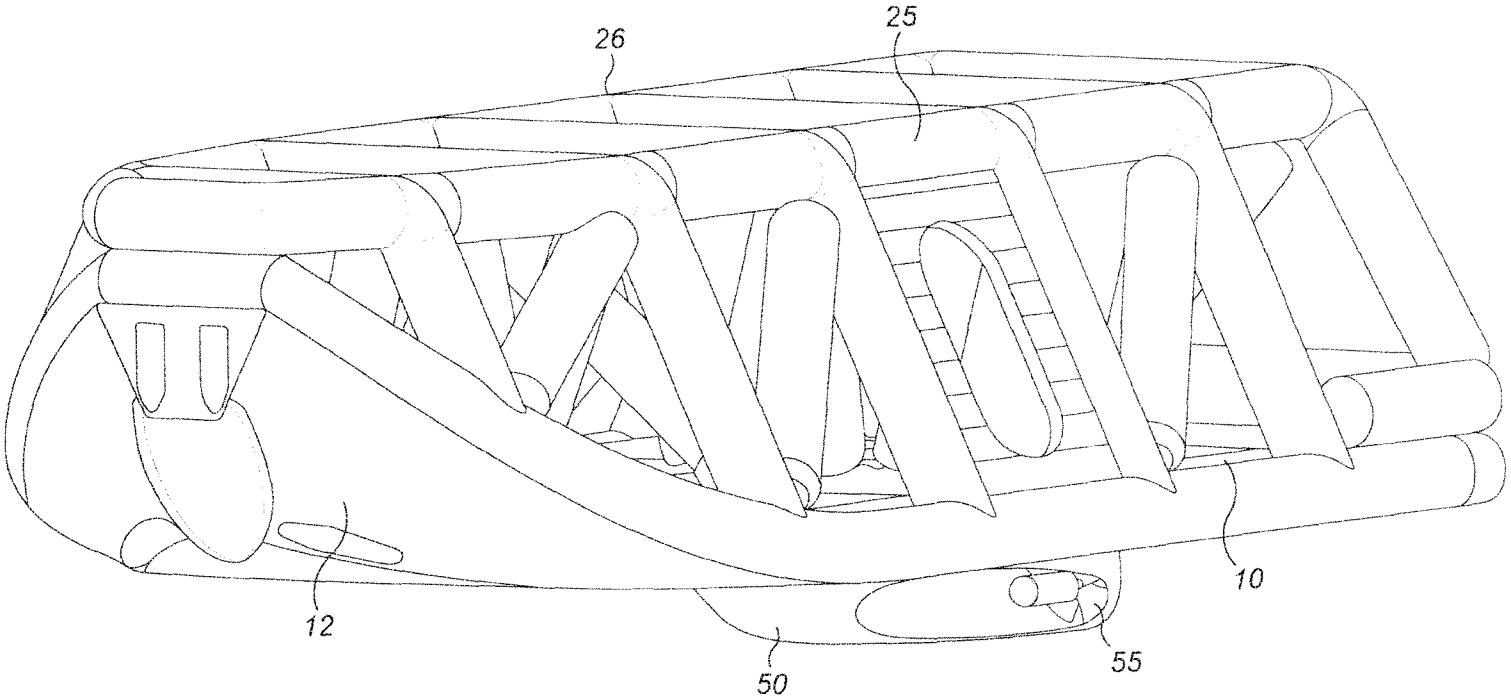
Figure 7:
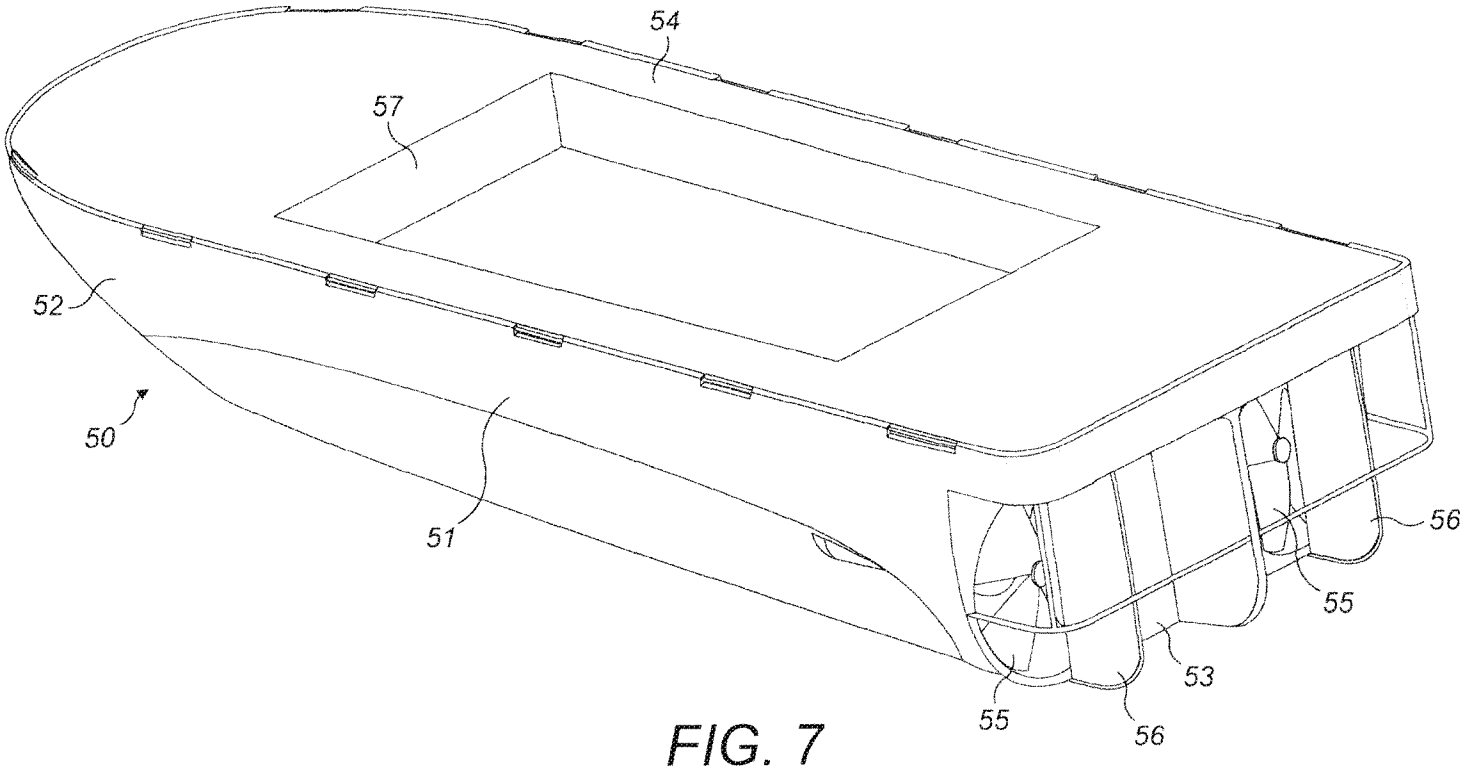
Figure 8:
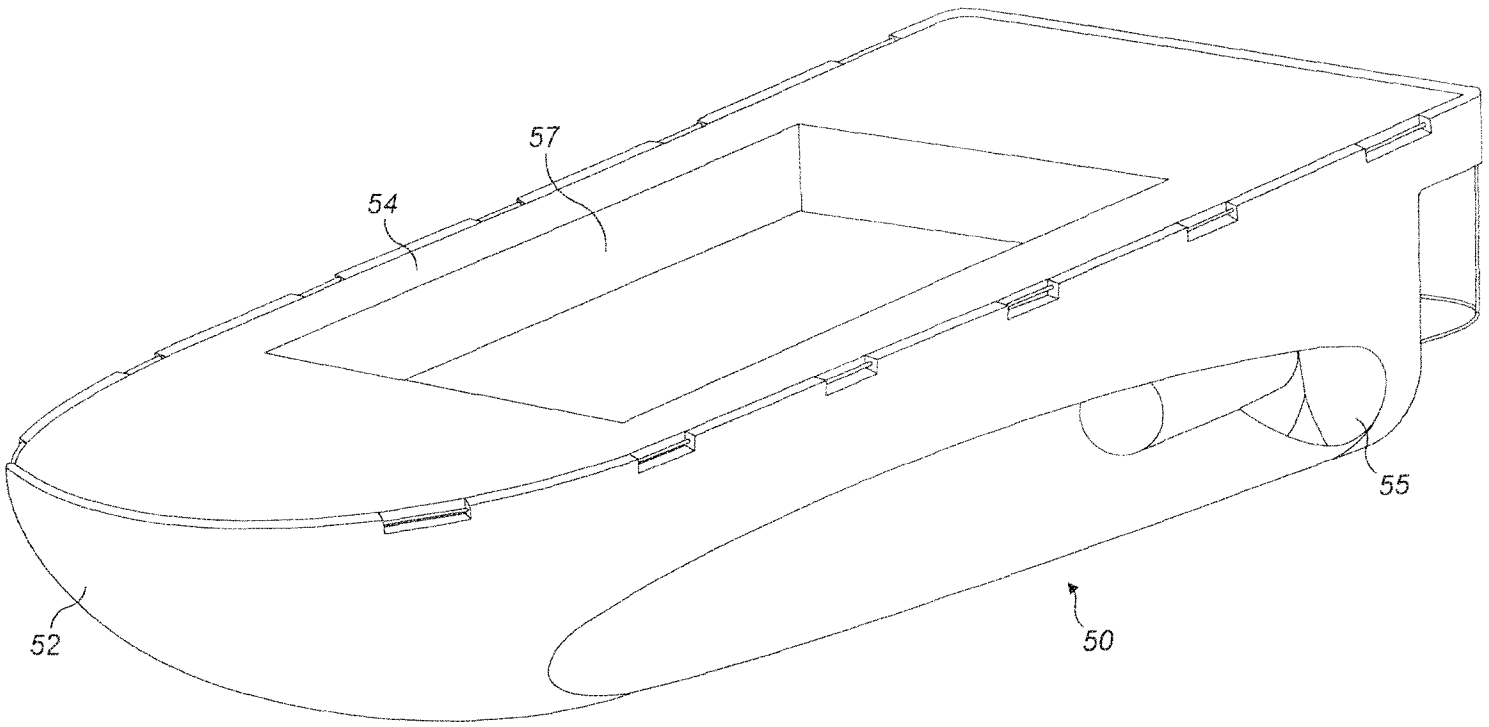
Figure 9:
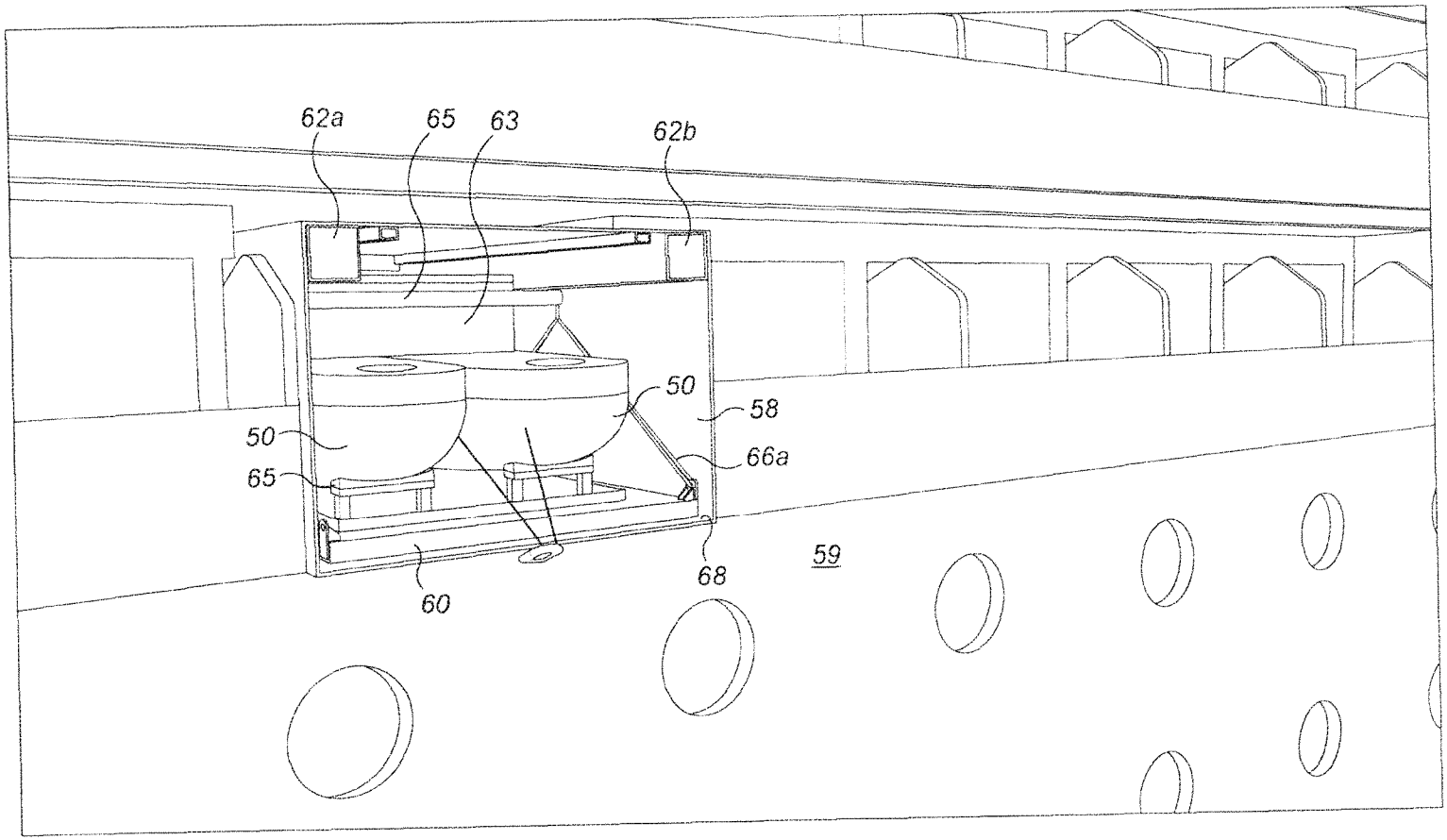
Figure 10:
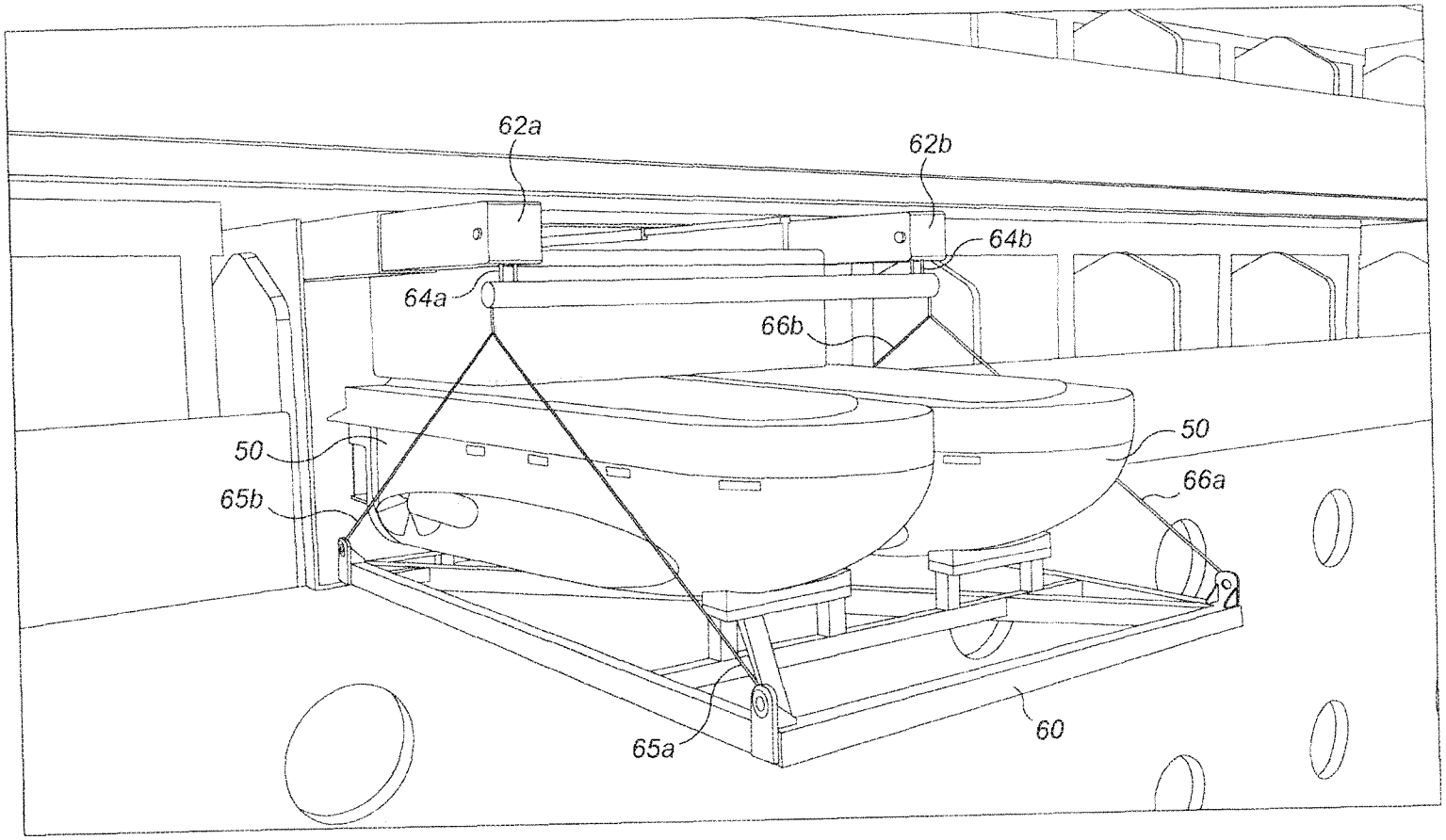
Figure 11:
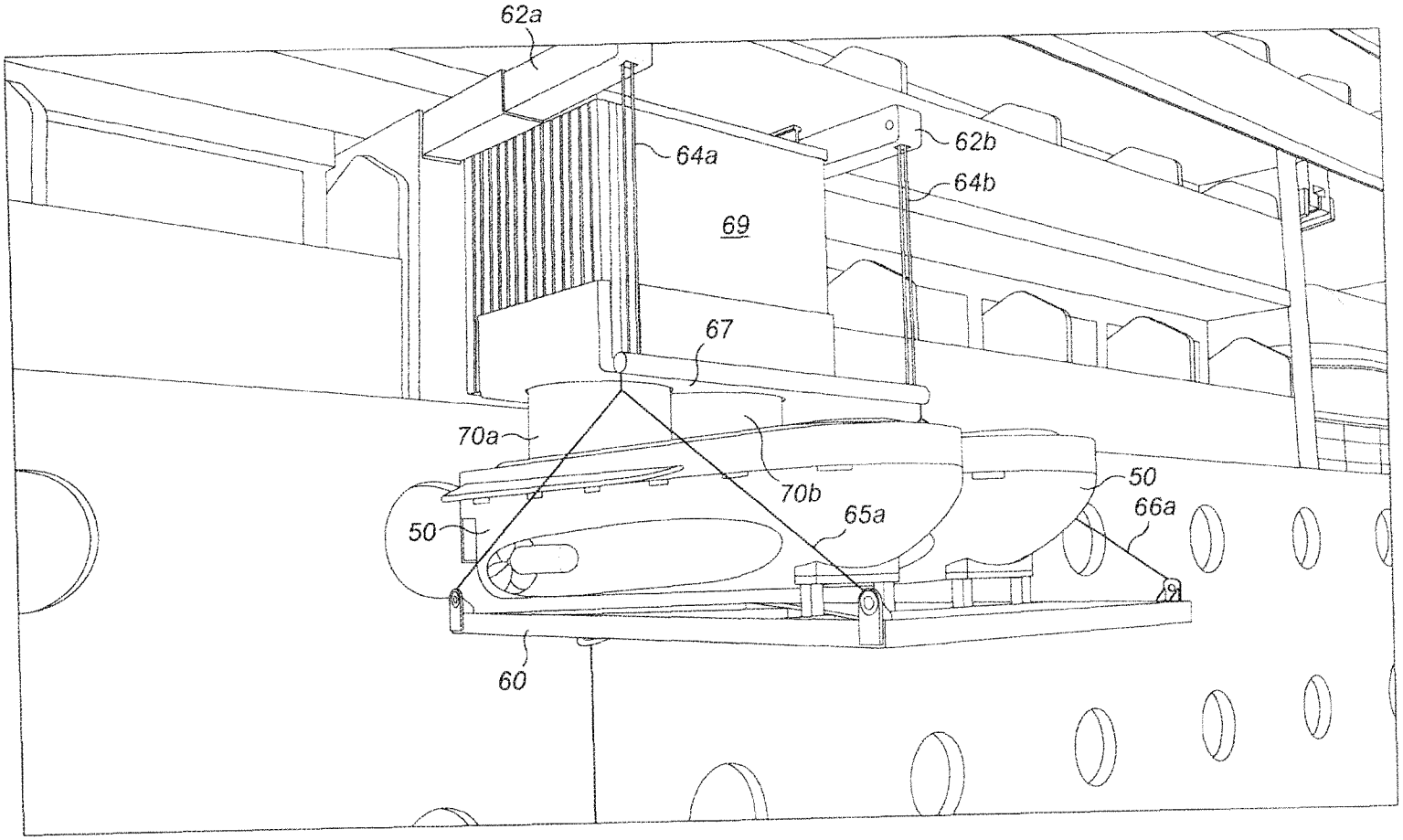
Figure 12:
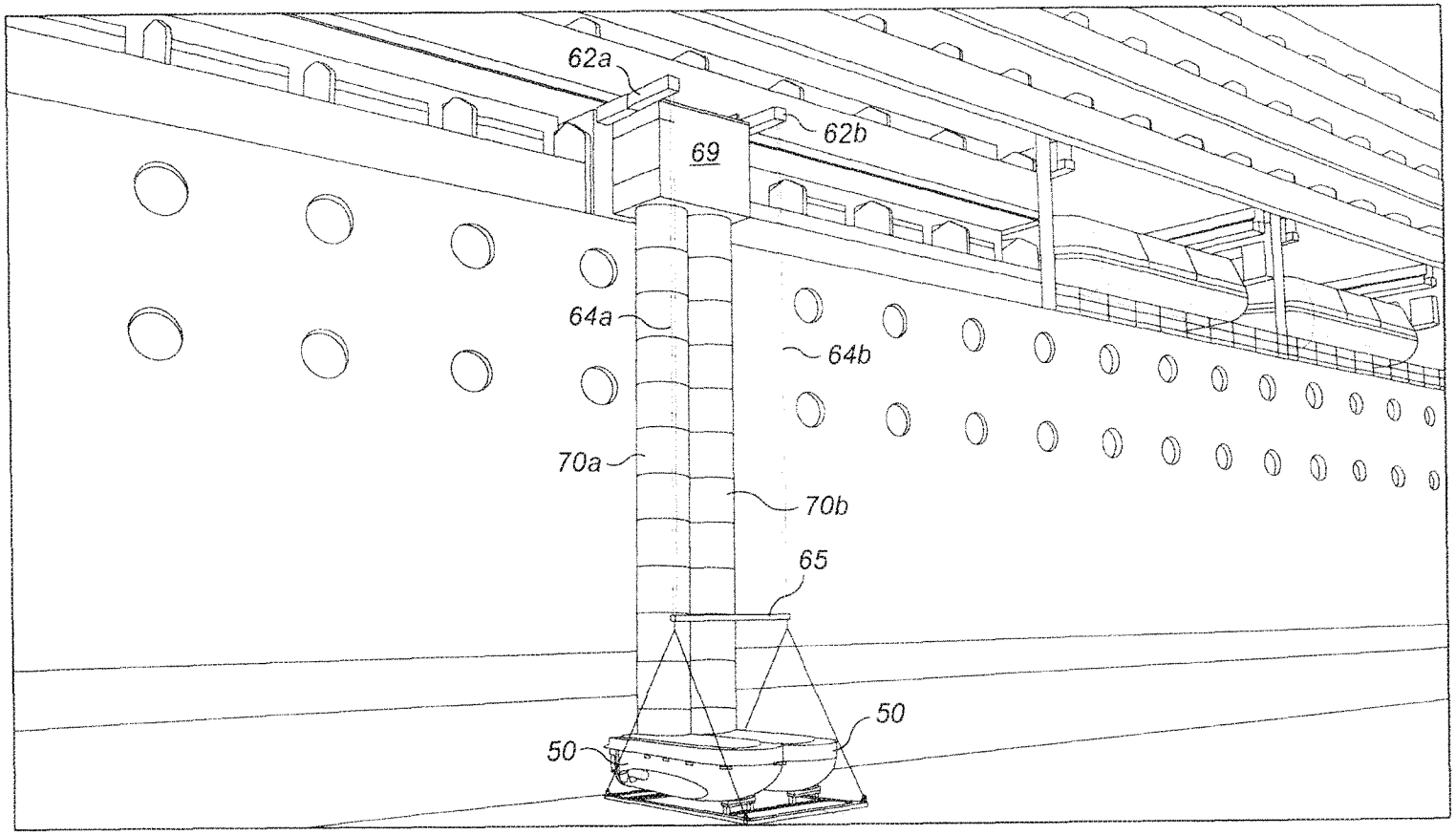
Figure 13:
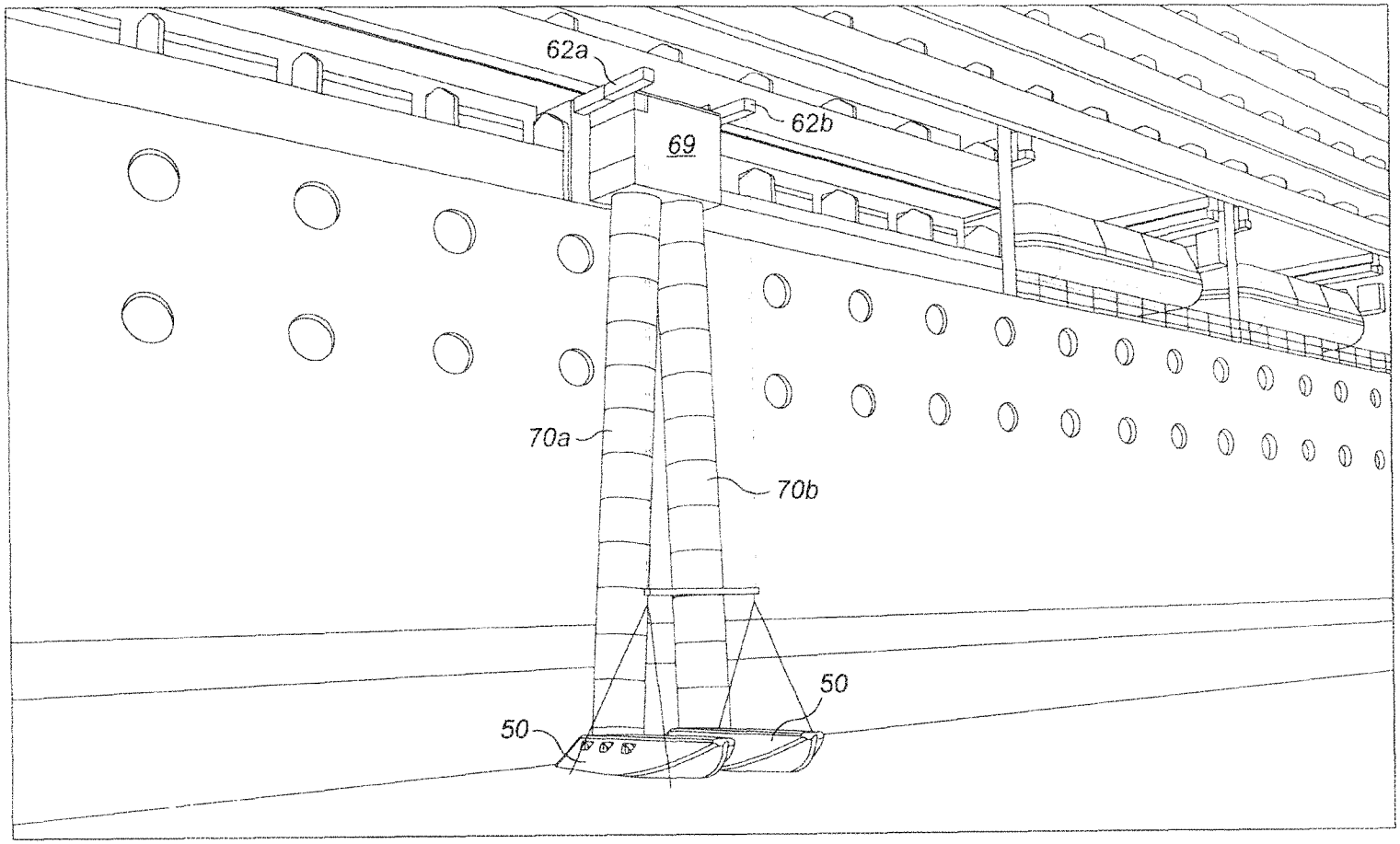
Figure 14:
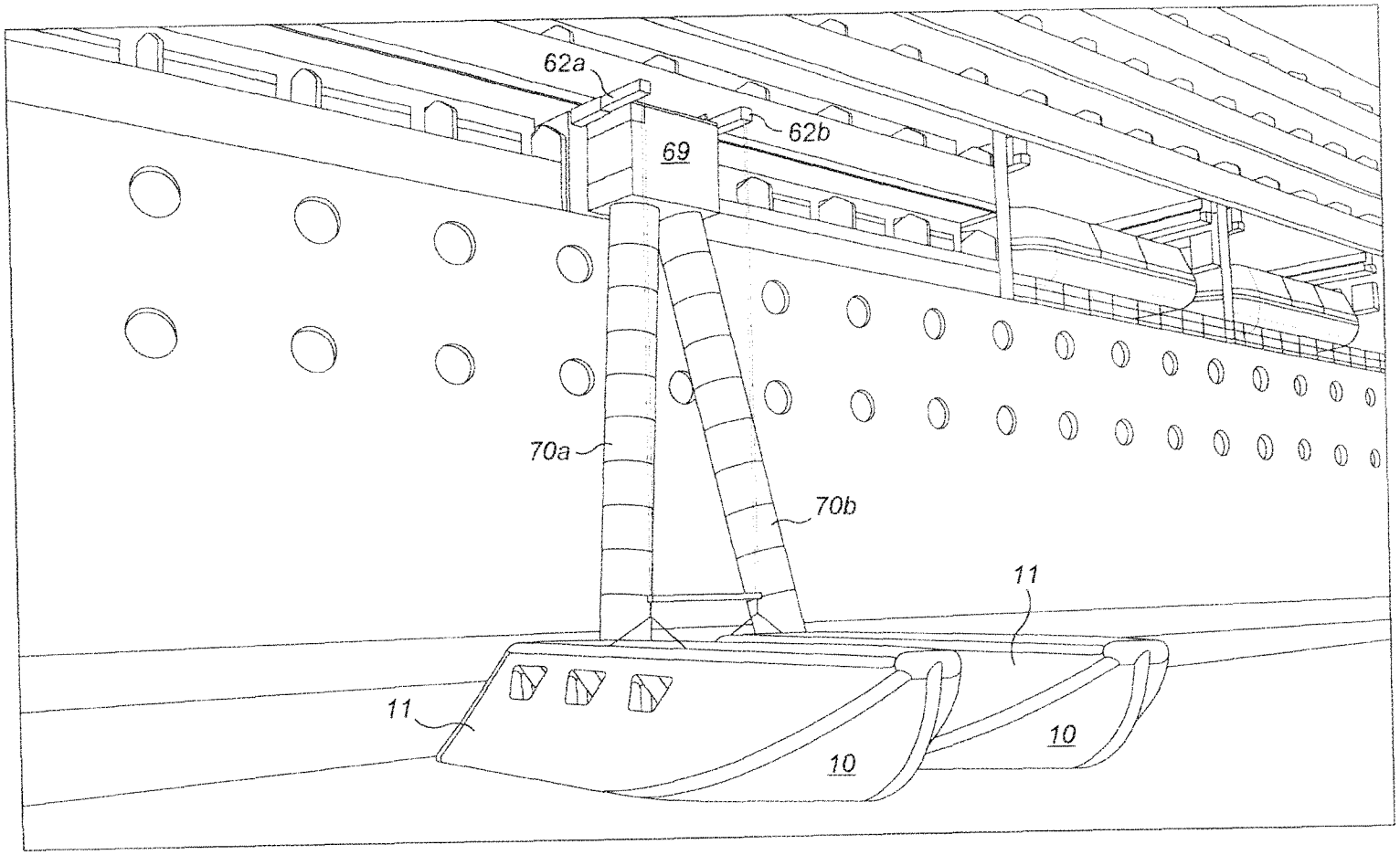
Figure 15:
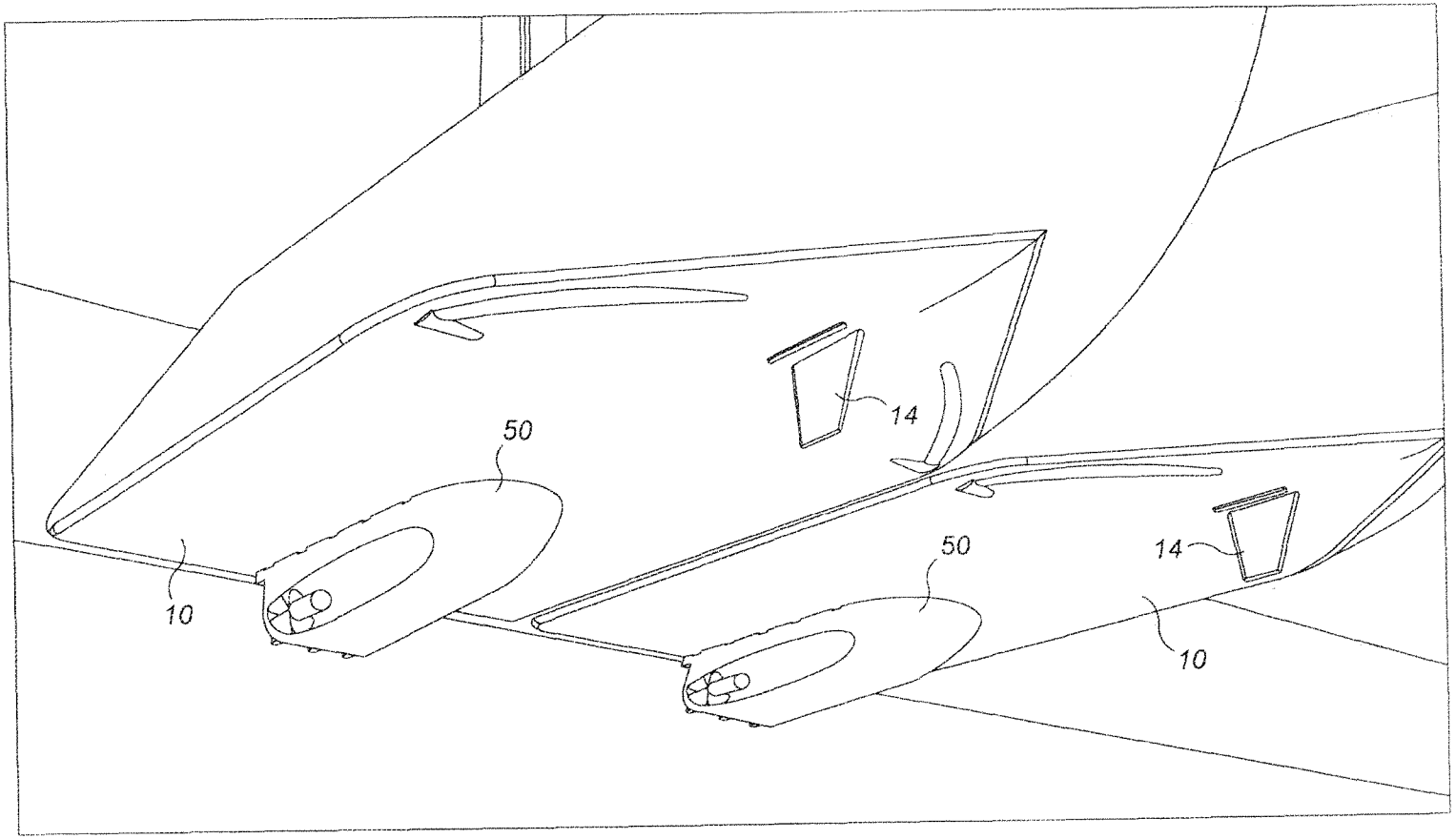
Figure 16:
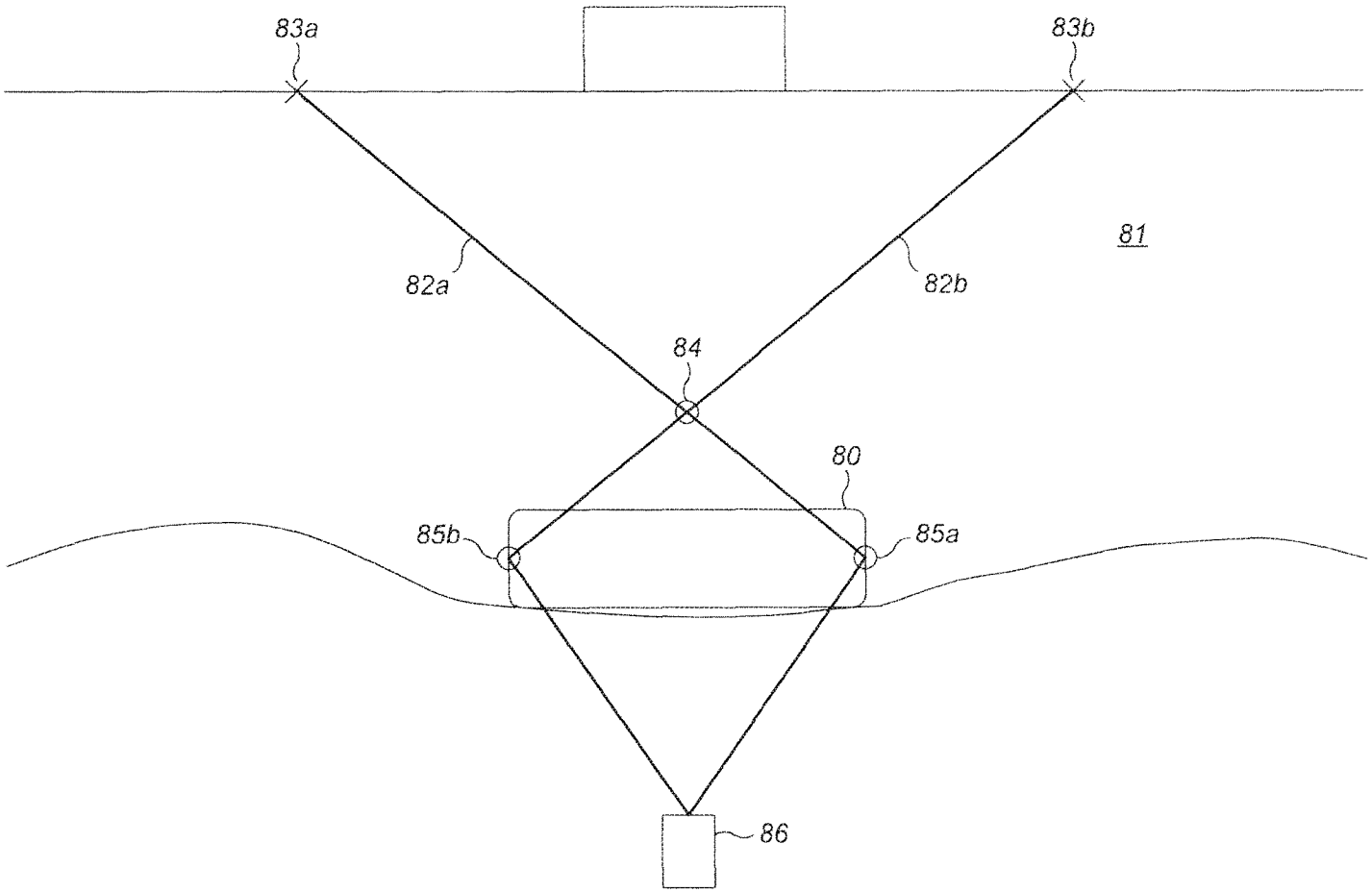
Figure 17:
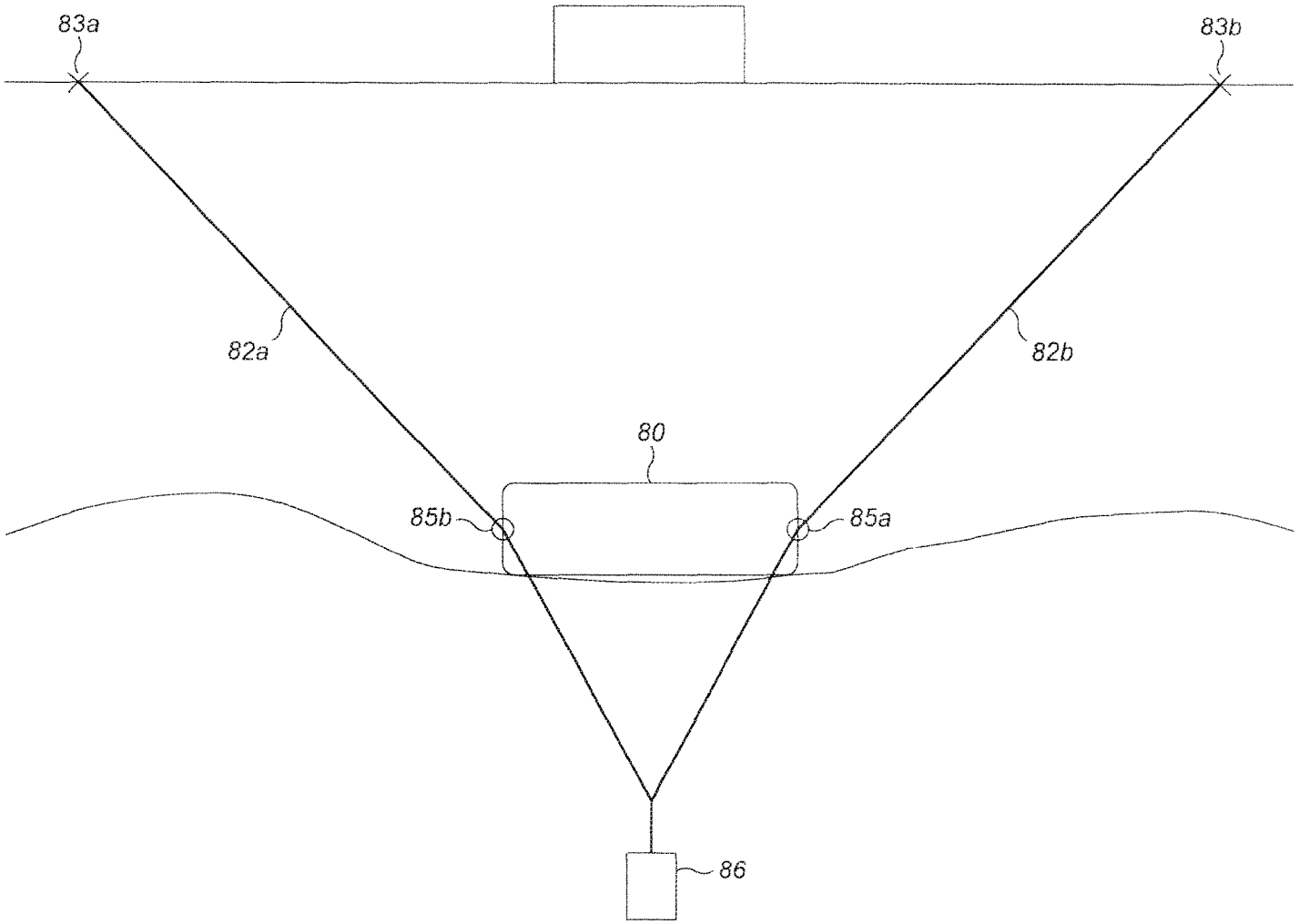

The following is a more detailed description of an embodiment of the invention, by way of example, reference being made to the accompanying drawings in which:

FIG. 1 is a schematic view from the rear, to one side and beneath of a first form of survival craft, FIG. 2 is a schematic view of the survival craft of FIG. 1 from the rear, to one side and above showing the internal structure of a super structure of the survival craft, FIG. 3 is a schematic view from the front, to one side and beneath of the survival craft of FIGS. 1 and 2 showing propulsion units and a skeg, FIG. 4 is a similar view to FIG. 2 showing an alternative form of the superstructure providing a self-righting capacity to the survival craft, FIG. 5 is a perspective view from the rear, beneath and to one side of a further form of survival craft with a hull and superstructure and with an outer cover of the superstructure removed and showing a propulsion pod beneath the hull, FIG. 6 is a view of the survival craft of FIG. 5 from the front and to one side, FIG. 7 is a first perspective view of the propulsion pod of FIGS. 5 and 6, FIG. 8 is a second perspective view of the propulsion pod of FIG. 7, FIG. 9 is a view of part of a side of a ship showing a marine escape system carrying two uninflated survival craft of the kind shown in FIGS. 5 to 8, FIG. 10 is a similar view to FIG. 9 showing a first stage of deployment of the two survival craft with the craft extended outwardly of the ship, FIG. 11 is a similar view to FIG. 10 showing a second stage of deployment with the two survival craft starting to be lowered towards the water and two chutes commencing deployment, FIG. 12 is a similar view to FIG. 11 showing a third stage of deployment with the two survival craft in the water and the chutes fully extended, FIG. 13 is a similar view to FIG. 12 showing the chutes separated, FIG. 14 is a similar view to FIG. 13 and showing the hulls and the superstructures of the survival craft inflated, FIG. 15 is a similar view to FIG. 14 and showing the undersides of the hull of the survival craft of FIG. 14, FIG. 16 is a schematic view of a first bowsing arrangement for bowsing a survival craft, such as the craft of FIGS. 1 to 15, against a marine structure, and FIG. 17 is a schematic view of a second bowsing arrangement for bowsing a survival craft, such as the craft of FIGS. 1 to 15, against a marine structure Referring first to FIGS. 1 and 2, the survival craft comprises a hull 10 and a superstructure 11 carried on the hull 10.

The hull 10 is formed by port and starboard inflatable tubes 12, 13 that extend along the gunwales of the hull 10 and extend upwardly while converging to meet at a shaped bow 14. At the stern 15, the tubes 12, 13 are spaced by a stern member 16. A floor 17 extends between the gunwale tubes 12, 13 and the stern member 16 and is formed by spaced sheets of air-impervious fabric forming an inflatable chamber. The spaced sheets may be formed by a drop thread material. In addition, as seen in FIG. 2 two longitudinal inflatable floor tubes 42, 43 may extend from the stern 15 to the bow 14. These tubes 42, 43 may also be formed of a drop thread material 45 to give these tubes 42, 43 increased rigidity.

The floor 17 carries a powered propulsion system for the survival craft. This may be an electrical system with a generator 17A, which may be a diesel power unit, mounted within the survival craft and electrical connections to fore and aft thrusters 18, 19 located beneath the floor 17. Each thruster 18, 19 includes an electrical motor 20 driving a shielded propeller 21 with the thrusters 18, 19 being steerable from within the hull 10. Of course, there could be more or less thrusters 18, 19 and they could be differently located on the hull 10.

The under surface of the hull 10 also carries a skeg 34 (see FIG. 3) located towards the bow 14 to give the hull 10 lateral stability. There may be more than one skeg 34.

The superstructure 11 is formed by a roof 22 and port and starboard sidewalls 23, 24. Each sidewall 23, 24 is formed by an upper elongate inflatable tube 25, 26 extending a long the length of the hull 10 generally parallel to the associated gunwale tubes 12, 13 with the upper tubes converging and meeting above the bow 14. At the stern, the upper tubes 25, 26 are separated by an upper stern spacer 27. The upper tubes 25, 26 are spaced by lateral inflatable spacer tubes 44 at spaced intervals along the upper tubes 25, 26. A sheet 28 of flexible water-impervious material extends between the upper tubes 25, 26 and forms a roof. Again, any or all of the tubes may be made from a drop thread material.

The side walls 23 24 are formed by inflatable side spacer tubes 29*a*-29*i* that extend between the gunwale tubes 12, 13 and the associated upper tubes 25, 26. The side spacer tubes 29*a*-29*i* are arranged in a zigzag configuration along the gunwale tubes 12, 13 with successive side spacer tubes 29*a*-29*i* being inclined in respective opposite directions relative to the gunwale tubes 12, 13. In addition, two inflatable stern tubes 30*a*, 30*b* extend in a V-configuration between the stern member 16 and the upper stern spacer 27. The inflatable side spacer tubes 29*a*-29*i* may be formed by consecutive sections of a single tube or by separate tubes. The tubes 29*a*-29*i* may be formed of a drop thread material. Sheets 31*a* 31*b*, 31*c* of flexible water-impervious material cover the sides of the superstructure 11 and the end of the superstructure 11 and are provided with door and window openings 32, 33.

In this way, the superstructure 11 forms a truss structure carried by the hull 10 that provides the hull 10 with increased longitudinal rigidity, resisting any tendency of the hull 10 to bow. In addition, it forms a protective shelter for occupants of the survival craft.

In use, the survival craft is deflated and packed in a container (not shown) that may be rigid or flexible. The container includes an inflation system (not shown) of any suitable known type. The container is carried by a deployment system that is for mounting on a marine structure such as a rig or a ship. The system may carry more than one such container.

When required for use, the system releases the container into the water. On reaching the water, the inflation system commences inflation of the survival craft and the container opens, so allowing the survival craft to complete inflation and deploy. People 21 from the marine structure can then enter the survival craft. The central floor tubes 42, 43 provide a pathway for persons entering the survival craft through the stern door 32 or for people entering the survival craft through the roof 28. The propulsion system is used to move the survival craft clear of the structure and to steer it. The survival craft may be accessed from the structure through a transfer system such as a chute or a slide. The chute or slide may lead directly into the survival craft, for example to an entrance through the roof 28 or to a point adjacent the stern door 32, or may lead to a platform adjacent the survival craft from which the survival craft may be accessed.

The provision of a rigid floor 17 reduces the tendency of the floor 17 to crease as the hull 10 travels through water so reducing the drag on the hull 10. The electrical thrusters 19 are compact and obviate the need for a drive shaft to pass through the hull 10—flexible electrical connections can run in any required path to the thrusters 18, 19, Since the thrusters 18, 19 are steerable, there is no requirement for separate steering such as a rudder. Of course, as an alternative, non-steerable thrusters could be used with a separate rudder.

The survival craft described above with reference to the drawings is more compact than rigid survival crafts and so occupies less space on a marine structure. This can be important on passenger ships where outside space to the sides of the ship is at a premium. At the same time, the survival craft has the advantage over unpowered inflatable life rafts that it is powered and steerable and so can be used to move persons clear of the marine structure.

Referring next to FIG. 4, this shows a self-righting version of the survival craft of FIGS. 1 to 3. Parts common to FIGS. 1 to 3, on the one hand, and to FIG. 4, on the other, are given the same reference numerals and will not be described in detail.

In this embodiment, the side walls 23, 24 include respective port and starboard intermediate elongate inflatable tubes 35, 36 located between the upper tubes 25, 26 and the gunwale tubes 12, 13. The port and starboard intermediate elongate inflatable tubes 35, 36 define intermediate lines 35A, 36A. The upper tubes 25, 26 are closer to a vertical plane extending through the centreline of the hull 10 than the intermediate tubes 35, 36. The side spacer tubes 29*a*-29*i* are fixed to the intermediate tubes 35, 36 and so the spacer tubes 29*a*, 29*i* incline inwardly from the intermediate tubes 35, 36 to the upper tubes 25, 26. The effect of this is to provide the survival craft with a more circular cross-sectional shape in planes normal to the length of the hull 10 and this provides the survival craft with a self-righting facility.

Of course, this could be provided in other ways. For example, inflatable bags may be carried on the superstructure 11 to provide a self-righting force.

As described above, the propulsion is supplied by electrically powered thrusters 18, 19 supplied with power though electrical cables leading from a generator within the hull 10. It would be possible to provide propulsion through a self-contained propulsion unit slung beneath the floor 17 and including a power source as well as propulsion means such as a propeller. Such a n arrangement has the advantage that the unit contributes to the self-righting of the survival craft. The propellers 21 may be replaced by, for example, a water jet.

The truss configuration of the upper tubes 25, 26 and the side spacer tubes 29*a*-29*i* may be varied while still providing additional longitudinal rigidity to the hull 10. For example, there could be a single upper tube or more than two upper tubes. The side spacer tubes 29*a*-29*i* may be angled differently and there may be more or less tubes or tube sections extending between the hull 10 and the upper tube or tubes 25, 26.

Referring next to FIGS. 5 to 15, there is shown a further from of survival craft and a marine escape system incorporating two such craft. The hull 10 and the superstructure 11 of the survival craft of FIGS. 5 to 15 are as described above with reference to FIGS. 1 and 2 and so will not be described in detail. The difference is in the propulsion of the craft. As seen in FIGS. 5 to 7, in this embodiment, a propulsion pod 50 is carried beneath the floor 17 of the hull 10. The pod 50 is formed from a rigid moulded plastics material. Referring particularly to FIGS. 7 and 8, the pod 50 has a hull 51 with a shaped bow 52 and a stern 53. A deck 54 forms with the hull 51 an enclosed chamber that contains a battery pack (not shown) and electric motors (not shown) that d rive respective propellers 55. The stern 54 amounts two steerable rudders 56. The rudders 56 are optional. The steering may be achieved by varying the thrust of the propellers 55 or other thrust producing systems.

The deck 54 is formed with a central rectangular depression 57. Prior to deployment, this depression 57 carries an inflation system of known kind (not shown) with the deflated and packed hull 10 and superstructure 11 (see FIG. 10) above in a weather valise.

A marine escape system for deploying two survival craft of the kind shown in FIGS. 5 to 8 is shown in FIGS. 9 to 15.

Referring first to FIG. 9, the system is mounted in a rectangular opening 58 formed in the side 59 of a ship (although it may be mounted on any suitable marine structure). The opening 58 contains a cradle 60. The cradle 60 is a rectangular framework of bars carrying side-by-side two propulsion pods 50 of the kind described above with reference to FIGS. 5 to 9 with respective packed hulls 10 and superstructures 11. The pods 50 are aligned in the cradle 60 with their longitudinal axes extending normal to the side of the ship. The cradle 60 is mounted in the opening for movement outwardly of the side 59 of the ship.

A pair of davits 62*a*, 62*b* is carried at the top of the opening 58 and a chute assembly 63 is carried on the propulsion pods 50. The chute assembly 63 will be described in more detail below. In normal operation, the opening is closed by a door (not shown). The davits 63*a*, 63*b* are connected by cables 64*a*, 64*b* to a bar 65 that is connected by cables 65*a*, 65*b*, 66*a*, 66*b* to the corners of the cradle 60 (see FIG. 10)

The deployment sequence is as follows, referring to FIGS. 10 to 15.

First, the door (not shown) is removed and may be allowed to fall to the water. This is the position shown in FIG. 9. Next, see FIG. 10, the davits 62*a*, 62*b* are extended so, via the cables 64, 64*b*, 65*a*, 65*b*, 66*a*, 66*a*, moving the cradle 60 so that it projects from the side 59 of the ship. The davits 62*a*, 62*b* then commence lowering the cradle 60 towards the water, see FIG. 11. The chute assembly 63 includes a floor 67 that lowers to form a contiguous surface with the floor 68 (see FIG. 9) of the opening 58. At the same time a curtain 69 deploys around the floor 67 to form an enclosed space with the opening 58. The chute assembly 63 also includes two escape chutes 70*a*, 70*b* that may be of any known type such as shown in U.S. Pat. No. 5,765,500 or GB2,080,844. These chutes 70*a*, 70*b* start to extend as seen in FIG. 11.

On reaching the water, as seen in FIG. 12, the pods 50 enter the water with the cradle 60 and, as seen in FIG. 13, eventually enter the water. The inflation systems are then actuated and the hulls 10 and the superstructures 11 inflated as seen in FIG. 14 so that two inflated survival craft float on the water with a chute 70*a*, 70*b* leading to the interior of each craft. As seen in FIG. 15, the cradle 60 is released from the pods 50 so that the survival craft float freely.

People on the ship then enter the opening 58 and move to the entrances of the chutes 70*a*, 70*b* in the floor 67 surrounded by the curtain 69. The people descend the chutes 70*a*, 70*b* and enter the craft. When loading is complete, the chutes 70*a*, 70*b* can be disconnected and the craft move away from the ship under the power and control of the propulsion pods 50, which may be connected to a control unit (not shown) within the craft.

As seen in FIGS. 9 to 15, the opening 58 takes up considerably less space on the side 59 of the ship than two conventional lifeboats 71. Each craft may have a capacity of 150-300 people.

Although the system is shown as including two pods 50, there may be more or less pods. In addition, each survival craft nay have more than one pod beneath the hull 10.

In any of the embodiments described above with reference to the drawings, the survival craft may be bowsed to the marine structure after deployment to stabilise the position of the craft relative to the structure. This can be by any known bowsing arrangement or by either of the arrangements now to be described with reference to FIGS. 16 and 17.

Referring first to FIG. 16, a survival craft 80, which may be a survival craft of any of the types described above with reference to the drawings, is located adjacent a marine structure 81, such as ship. First and second lines 82*a*, 82*b* are attached to the structure 81 at respective first and second laterally spaced points 83*a*, 83*b*, with spacing being greater than the dimension of the craft 80 along the structure 81 (the craft may extend parallel to or normal to the structure 81). The lines 82*a*, 82*b* cross as they pass through a first guide 84 above the craft 80 before passing through respective second and third running guides 85*a*, 85*b* located at respective opposite edges of the dimension of the craft 80 before meeting at, and being fixed to, a weight 86 beneath the craft 80.

FIG. 16 shows the craft 80 in an equilibrium position relative to the structure 81. If the craft 80 moves to the right, as seen in FIG. 16, the distance between the first point 83*a* and the second guide 85*a* lengthens and the distance between the second point 83*b* and the third guide 85*b* shortens so that the weight 86 is raised towards the second guide 85*a*. This causes the weight 86 to apply a force to the craft 80 at the second guide 85*a* that tends to return the craft 80 to the equilibrium position.

If the craft 80 moves to the left as seen in FIG. 16, the weight applies a restoring force to the craft 80 at the third guide 85*b*.

In this way the position of the craft 80 can be stabilised relative to the structure 81.

Referring next to FIG. 17, parts common to FIG. 16 and to FIG. 17 are given the same reference numerals and will not be described in detail. In the bowsing arrangement of FIG. 17, the lines 82*a*, 82*b* do not cross. The spacing of the first and second points 83*a*, 83*b* is wider than in FIG. 2.

The arrangement of FIG. 17 operates on the same principle as the arrangement of FIG. 16. If the craft 80 to the right, as seen in FIG. 17, the distance between the first point 83*a* and the second guide 85*a* lengthens and the distance between the second point 83*b* and the third guide 85*b* shortens so that the weight 86 is raised towards the second guide 85*a*. This causes the weight 86 to apply a force to the craft 80 at the second guide 85*a* that tends to return the craft 80 to the equilibrium position.

If the craft 80 moves to the left as seen in FIG. 17, the weight applies a restoring force to the craft 80 at the third guide 85*b*.

In this way the position of the craft 80 can be stabilised relative to the structure 81.

Of course, the bowsing arrangements described above with reference to the drawings need not be used with the survival craft described above with reference to the drawings. They could be used to stabilise any floating body against a marine structure. In addition, other arrangements of the lines 82*a*, 82*b* could provide the same effect by holding a weight beneath floating body in an equilibrium position when the body is in a desired position relative to the marine structure and moving the weight away from the equilibrium position as the body moves from the desired position so that the weight applies a restoring force tending to return the body to the desired position.

The invention claimed is:

1. A bowsing arrangement for holding a floating body in a desired position along the side of a marine structure, the bowsing arrangement comprising two lines connected between the marine structure, the floating body and a weight provided in an equilibrium position beneath the floating body, the two lines connected to the same weight, the weight being in the equilibrium position when the floating body is in the desired position relative to the marine structure, wherein the lines move the weight away from the equilibrium position as the floating body moves from the desired position and wherein when the weight moves away from the equilibrium position the weight applies a restoring force to the lines tending to return the floating body to the desired position.

2. A bowsing arrangement according to claim 1 wherein each line is fixed at one end to a respective point on the marine structure above the floating body, the two points being on either side of the desired position of the floating body and being spaced by a distance greater than the dimension of the floating body along the side of the marine structure.

3. A bowsing arrangement according to claim 1 wherein each line engages the floating body at respective opposite ends of the dimension of the floating body along the side of the marine structure, the connections allowing the lines to move relative to the floating body.

4. A bowsing arrangement according to claim 1 wherein the lines intersect above the floating body.

5. A bowsing arrangement according to claim 1 wherein each line extends from a respective point on the marine structure to an associated end of the dimension of the floating body along the side of the marine structure that is closest to said point.

* * * * *